US006142740A

United States Patent [19]

Connell

[11] Patent Number: 6,142,740

[45] Date of Patent: Nov. 7, 2000

[54] COMPRESSION SYSTEM HAVING MEANS FOR SEQUENCING OPERATION OF COMPRESSORS

[75] Inventor: Marty L. Connell, Charlotte, N.C.

[73] Assignee: Ingersoll-Rand Company, Woodcliff Lake, N.J.

[21] Appl. No.: 09/200,065

[22] Filed: Nov. 25, 1998

[51] Int. Cl.[7] ..... F04B 41/06

[52] U.S. Cl. ..... 417/2; 417/8

[58] Field of Search ..... 417/8, 2, 12, 223; 62/157

[56] References Cited

U.S. PATENT DOCUMENTS

| | | | |
|---|---|---|---|
| 1,780,380 | 11/1930 | Durdin, Jr. | 417/8 |
| 2,970,744 | 2/1961 | Hines | 417/8 |
| 3,294,023 | 12/1966 | Vegue, Jr. et al. | 417/8 |
| 3,463,382 | 8/1969 | Wusteney | 417/8 |
| 3,744,932 | 7/1973 | Prevett | 417/8 |
| 4,502,842 | 3/1985 | Currier et al. | 417/8 |
| 4,551,068 | 11/1985 | Boudreaux | 417/8 |
| 4,580,947 | 4/1986 | Shibata et al. | 417/8 |
| 4,614,089 | 9/1986 | Dorsey | 62/158 |
| 5,123,256 | 6/1992 | Oltman | 62/175 |
| 5,195,329 | 3/1993 | Lewis et al. | 62/117 |
| 5,231,846 | 8/1993 | Goshaw et al. | 62/175 |
| 5,343,384 | 8/1994 | Fisher et al. | 417/8 |

*Primary Examiner*—Noah P. Kamen
*Assistant Examiner*—Mahmoud M Gimie
*Attorney, Agent, or Firm*—Foley & Lardner

[57] ABSTRACT

A compression system includes a sequencing switch movable between a first switch position and a second switch position for alternating a first compressor and a second compressor between a lead mode and a lag mode so that one of the compressors is always in the lead mode and one of the compressors is always in the lag mode. The compression system includes a first compressor including a first microcontroller having a data entry device for establishing a lead mode pressure range and a lag mode pressure range. The first compressor includes a first pressure gauge for sensing the pressure level of compressed fluid discharged therefrom and for relaying the sensed pressure level to the first microcontroller. The first microcontroller continuously monitors the pressure level of the compressed fluid discharged from the first compressor and compares the pressure level of the compressed fluid to the lead mode pressure range and the lag mode pressure range. The second compressor includes a second microcontroller having a data entry device for establishing a lead mode pressure range and a lag mode pressure range, the second compressor including a second pressure gauge for sensing a pressure level of compressed fluid discharged therefrom and for relaying the sensed pressure level to the second microcontroller. The second microcontroller continuously monitors the pressure level of the compressed fluid discharged from the second compressor and compares the sensed pressure level of the compressed fluid to the lead mode pressure range and the lag mode pressure range. The first microcontroller and the first pressure gauge function independently of the second microcontroller and the second pressure gauge, thereby obviating the need for additional external controllers which are generally complex and costly.

19 Claims, 7 Drawing Sheets

COMPRESSION SYSTEM HAVING MEANS FOR SEQUENCING OPERATION OF COMPRESSORS

BACKGROUND OF THE INVENTION

1. Field of the Invention

The present invention relates to compression systems for supplying compressed fluid and more specifically relates to a compression system which provides for efficient load sharing between at least two compressors without requiring an external controller for measuring the load-sharing operation.

2. Brief Description of the Prior Art

Compressed fluids such as air are typically used as the power source for equipment and tools in facilities such as manufacturing plants and construction sites. In such facilities, the demand for compressed fluid may fluctuate dramatically. In order to satisfy this continuously changing demand for compressed fluid, compression systems may be arranged in a sequencing or load-sharing configuration whereby two or more compressors are connected in parallel and have a total capacity which is large enough to meet the maximum load demands of the facility. These sequencing systems generally modify the volume of compressed fluid produced by the system by increasing or decreasing the number of compressors running at any one time. When the demand for compressed air increases, additional compressors are started up and placed "on-line." In contrast, when the demand for compressed fluid at the facility decreases, such as during a shift change, it is generally desirable to shut down one or more of the compressors because the demands on the system can be satisfied by fewer compressors. The use of sequencing systems generally results in a tremendous costs savings because the system only produces as much compressed fluid as is required by the facility. These systems also alternate the load-sharing duties of the individual compressors, thereby extending the life of the individual compressors and reducing maintenance costs.

One method for sequencing operation of a plurality of compressors is disclosed in U.S. Pat. No. 4,580,947. In one preferred embodiment, the '947 patent discloses a method of controlling the operation of a plurality of compressors, wherein a control system has a compressor control loop and a capacity control loop. The capacity control loop is further divided into a first loop for controlling a compressor which is to be stopped first and a second sub-loop for controlling the other compressors. The unloading is conducted first by the first sub-loop for controlling the compressor due to be stopped while the on-loading is conducted first by the second sub-loop for the other compressors.

Commonly assigned U.S. Pat. No. 5,343,384 discloses methods and apparatus for controlling a system of compressors to achieve load sharing. In accordance with one particular preferred embodiment, load sharing in a compression system is achieved by providing a program stored in a computer which sends signals to, and receives data from, microcontrollers located at each respective compressor. The respective microcontrollers communicate with the computer by way of a bidirectional network so that certain functions of the respective microcontrollers may be controlled by the program in the computer. One compressor, designated as the lead compressor, furnishes its operating parameters, via the computer, to all the other, lag compressors. The operating parameters include inlet valve position and bypass valve position of each compressor whereby the microcontroller for the compressor controls the actuation of both valves. When the system demand decreases, one or more compressors are gradually unloaded, stopped and then moved to an "off-line" status. When the system demands increase, one or more compressors are first started, and then gradually loaded before going on-line. Compressors go both on-line and off-line subject to certain time delays so that compressors are gradually added to, or removed from, the load. To equalize running time, all compressors in the system may undergo a periodic rotation and compressors go off-line in reverse order that they came on-line.

The methods and apparatus disclosed in the '384 patent have generally improved the performance of fluid compression systems by providing numerous benefits such as energy savings, extending the life of the individual compressors and reducing maintenance costs. However, certain preferred embodiments disclosed in the '384 patent utilize an external controller or computer. The addition of the external computer or controller to manage the load-sharing of a compression system adds to the overall complexity and cost of the system. Yet, there are certain instances where the compression system comprises only two compressors so that the addition of an external controller or external pressure sensor is neither necessary nor cost effective.

Thus, there is a need for a compression system capable of sequencing the operation of two compressors without using additional external controllers and sensors, whereby when two compressors are connected to the same air system and their pressure bands are substantially equal, setting one compressor to "lead" and the other to "lag" with a "lag offset" will result in a simple sequence operation.

SUMMARY OF THE INVENTION

In accordance with certain preferred embodiments of the present invention, a compression system includes means for sequencing operation of a first compressor and a second compressor so that each said compressor alternates between a lead mode and a lag mode. The compressors may be rotary compressors, reciprocating compressors, centrifugal compressors, compressors using acoustic sound wave technology or any combination thereof. For example, in certain embodiments one compressor may be a rotary compressor and the second compressor may be a reciprocating compressor. In preferred embodiments, the compressor in the lead mode is the primary source of compressed fluid for the system and the compressor in the lag mode is the secondary source of compressed fluid for the system. In other words, the compressor in the lag mode will generally operate for less total time then the compressor in the lead mode and will preferably only operate when the lead compressor is unable to meet all of the compressed air needs for the system.

The sequencing means may include a switch movable between a first switch position and a second switch position for alternating the status of the first and second compressors so that one of the compressors is always in the lead mode and one of the compressors is always in the lag mode. In preferred embodiments, when the switch is in the first switch position the first compressor is in the lead mode and the second compressor is in the lag mode and when the switch is in said second switch position the first compressor is in the lag mode and the second compressor is in the lead mode. The movable switch may also include a timing device for automatically moving the switch between the first and second switch positions. The timing device may includes an analog timing device, a digital timing device, an electrical timing device or a mechanical timing device.

The first compressor preferably includes means for operating the first compressor within a lead mode pressure range when the first compressor is switched into the lead mode and a lag mode pressure range when the first compressor is switched into the lag mode. Similarly, the second compressor also includes means for operating the second compressor within a lead mode pressure range when the second compressor is in the lead mode and within a lag mode pressure range when the second compressor is in the lag mode The operating means of each compressor desirably includes a microcontroller having a data entry device, such as a control panel having a display screen and data entry keys, for establishing the lead mode pressure range and the lag mode pressure range. The operating means of each compressor may also include a pressure gauge for determining a pressure level of the compressed fluid discharged from that particular compressor. In certain preferred embodiments, the pressure gauge of each compressor senses the pressure level of the compressed fluid discharged therefrom and relays the sensed pressure level to the microcontroller associated with the compressor. The microcontroller preferably continuously monitors the pressure level of the compressed fluid and compares the pressure level of the compressed fluid to either the lead mode pressure range or the lag mode pressure range, depending upon whether the compressor is in the lead mode or the lag mode.

In preferred embodiments, when one of the compressors is in the lead mode the microcontroller associated therewith generates signals for operating the compressor if the sensed pressure level is less than or within the lead mode pressure range. When the compressor is in the lag mode, the microcontroller generates signals for operating the compressor if the sensed pressure level is less than or within the lag mode pressure range. The lead mode pressure range preferably includes a lower pressure limit and an upper pressure limit so that when each compressor is in the lead mode the compressor commences operation for generating the compressed fluid when the pressure level is less than the lower pressure limit and ceases operation of the compressor when the pressure level is greater than or equal to the upper pressure limit. The microcontroller for each compressor preferably determines the lower pressure limit of the lag mode pressure range by subtracting a lag offset value from the lower pressure limit of the lead mode pressure range for the compressor. Similarly, the microcontroller for each compressor preferably determines the upper pressure limit of the lag mode pressure range by subtracting the lag offset value from the upper pressure limit of the lead mode pressure range for the compressor. In preferred embodiments, the lag offset value for each compressor is entered into the respective microcontroller through the data entry device associated with each microcontroller.

The lag mode pressure range preferably includes a lower pressure limit and an upper pressure limit so that when each compressor is in the lag mode the compressor commences operation for generating the compressed fluid when the pressure level is less than the lower pressure limit and ceases operation of the compressor when the pressure level is greater than or equal to the upper pressure limit. The lag mode pressure range for each compressor is preferably lower than the lead mode pressure range thereof. However, in certain embodiments the lag mode pressure range may be equal to or higher than the lead mode pressure range associated therewith. In other preferred embodiments, the lag mode pressure range of the second compressor overlaps with at least a portion of the lead mode pressure range of the first compressor, and the lag mode pressure range of the first compressor overlaps with at least a portion of the lead mode pressure range of the second compressor. As mentioned above, the difference between the upper pressure limit of the lead mode pressure range and the upper pressure limit of the lag mode pressure range for each compressor is generally determined using the lag offset value. The desired upper and lower limits of the lead mode pressure range, the desired upper and lower limits of the lag mode pressure range and the desired lag offset value are established by sending such data to the microcontroller through the data entry device connected to the microcontroller.

The compression system may also include a storage tank in fluid communication with the first and second compressors for receiving and storing the compressed fluid generated by the compressors.

In further preferred embodiments, a compression system includes a switch movable between a first switch position and a second switch position for alternating a first compressor and a second compressor between a lead mode and a lag mode so that one of the compressors is always in the lead mode and one of the compressors is always in the lag mode. The switch may include a digital switch, a manual switch, a mechanical switch or an electromechanical switch. The system may include a first compressor having a first microcontroller with a data entry device for establishing a lead mode pressure range and a lag mode pressure range. The first compressor includes a first pressure gauge for sensing the pressure level of compressed fluid discharged therefrom and for then relaying the sensed pressure level to the first microcontroller, the first microcontroller continuously monitoring the pressure level of the compressed fluid and comparing the sensed pressure level to the lead mode pressure range and the lag mode pressure range. The second compressor includes a second microcontroller having a data entry device for establishing a lead mode pressure range and a lag mode pressure range, the second compressor including a second pressure gauge for sensing a pressure level of compressed fluid discharged therefrom and relaying the sensed pressure level to the second microcontroller. The second microcontroller continuously monitors the pressure level of the compressed fluid discharged therefrom and compares the pressure level to the lead mode pressure range and the lag mode pressure range. The first microcontroller and first pressure gauge function independently of the second microcontroller and second pressure gauge. In other words, the first and second compressors do not share information with one another nor do they send system operating data to one or more external computers or controllers for managing operation of the compressors. As such, the system is simple and cost effective.

The foregoing and other aspects, objects, features and advantages of the present invention will be apparent from the detailed description of preferred embodiments which follows as well as from the accompanying drawings.

DETAILED DESCRIPTION OF PREFERRED EMBODIMENTS

Figure 1:
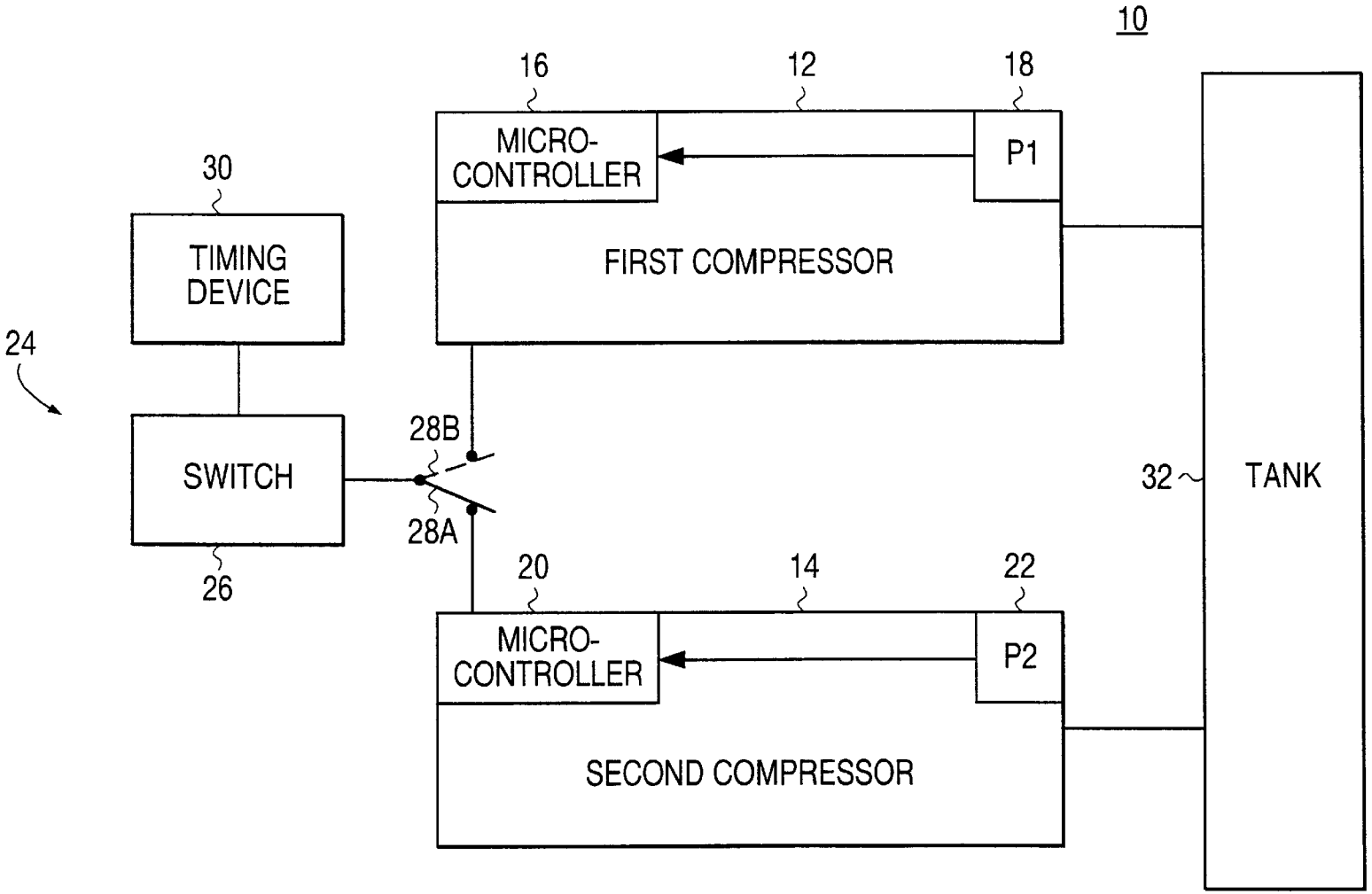
FIG. 1 shows a schematic representation of a compression system capable of sequencing operation of a first compressor and a second compressor so that each compressor alternates between a lead mode and a lag mode, in accordance with certain preferred embodiments of the present invention.

FIG. 1 shows a compression system 10 which is designed for sequencing the operation of a first compressor 12 and a second compressor 14 so that the compressors regularly alternate between a lead mode and a lag mode with one of the compressors always in the lead mode and one of the compressors always in the lag mode.

The compression system 10 includes the first compressor 12 having a first microcontroller 16 with a data entry device (not shown) for establishing a lead mode pressure range utilized when the first compressor 12 is the lead compressor for the system 10 and a lag mode pressure range utilized when the first compressor 12 is the lag compressor for the system 10. The first compressor 12 includes a first pressure gauge 18 for sensing a pressure level of compressed fluid discharged therefrom. The first pressure gauge 18 is connected to the first microcontroller 16 for relaying the sensed pressure level data to the first microcontroller 16. During operation of the system 10, the first microcontroller 16 continuously monitors the pressure level of the compressed fluid being discharged from the first compressor 12 and compares the pressure level of the compressed fluid to the lead mode pressure range when the first compressor 12 is in the lead mode and the lag mode pressure range when the first compressor 12 is in the lag mode.

The compression system 10 also includes the second compressor 14 having a second microcontroller 20 with a data entry device (not shown) for establishing a lead mode pressure range for when the second compressor 14 is the lead compressor for the system and a lag mode pressure range for when the second compressor 14 is the lag compressor for the system 10. The second compressor 14 includes a second pressure gauge 22 for sensing a pressure level of compressed fluid discharged therefrom. The second pressure gauge 22 is connected to the second microcontroller 20 for relaying the sensed pressure level data to the second microcontroller 20. During operation of the system, the second microcontroller 20 continuously monitors the pressure level of the compressed fluid being discharged from the second compressor 14 and compares the pressure level of the compressed fluid to the lead mode pressure range when the second compressor 14 is in the lead mode and the lag mode pressure range when the second compressor is in the lag mode.

In preferred embodiments, the first and second compressors 12 and 14 operate independently of one another. In other words, the two compressors are not connected to one another, do not share data with one another, nor do they send data to an external computer or controller which manages the overall load-sharing duties of the two compressors. Moreover, the compressor system 10 preferably does not include an external pressure gauge which monitors the downstream pressure of the system, i.e., the aggregate pressure produced by both compressors.

The compression system 10 also includes a sequencing element 24 for alternating the first and second compressors 12 and 14 between a lead mode status wherein the lead compressor is the primary source of compressed fluid for the system and a lag mode status wherein the lag compressor is the secondary source of compressed fluid for the system. In certain preferred embodiments, the sequencing element 24 includes a switch 26 movable between a first switch position 28A and a second switch position 28B for alternating the status of the first and second compressors 12 and 14 so that one of the compressors is always in the lead mode and one of the compressors is always in the lag mode. FIG. 1 shows the movable switch in the first switch position 28A, whereby the first compressor 12 is the lead compressor for the system 10 and the second compressor 14 is the lag compressor for the system 10. However, the switch 26 is movable to a second switch position 28B (shown by the dashed line in FIG. 1), whereby the first compressor 12 is the lag compressor for the system and the second compressor 14 is the lead compressor for the system 10. In certain embodiments the switch 26 may be moved manually between the first and second switch positions 28A and 28B. However, in other preferred embodiments, the sequencing element includes a timing device 30 for automatically moving the switch 26 between the first and second switch positions. The timing device 30 is preferably designed to repeatedly move the switch 26 back and forth between the first and second switch positions 28A and 28B after a predetermined period of time has elapsed so that the two compressors 12 and 14 operate for approximately an equal period of time as the lead compressor and the lag compressor. Alternating the compressors 12 and 14 between the lead and lag modes prevents excessive use of any one compressor. In one particular embodiment, the timing device 30 is set to change switch positions approximately every 60 minutes. However, it is contemplated that the period of time established for changing the position of the switch may be modified by an operator or in response to the requirements placed upon the compression system 10.

The compression system 10 also preferably includes a storage tank 32 which is in fluid communication with the first and second compressors 12 and 14 for receiving and storing the compressed fluid which is generated by the compressors.

Operation of the compression system 10 will be discussed in more detail below.

Main Control Routine

Figure 2:
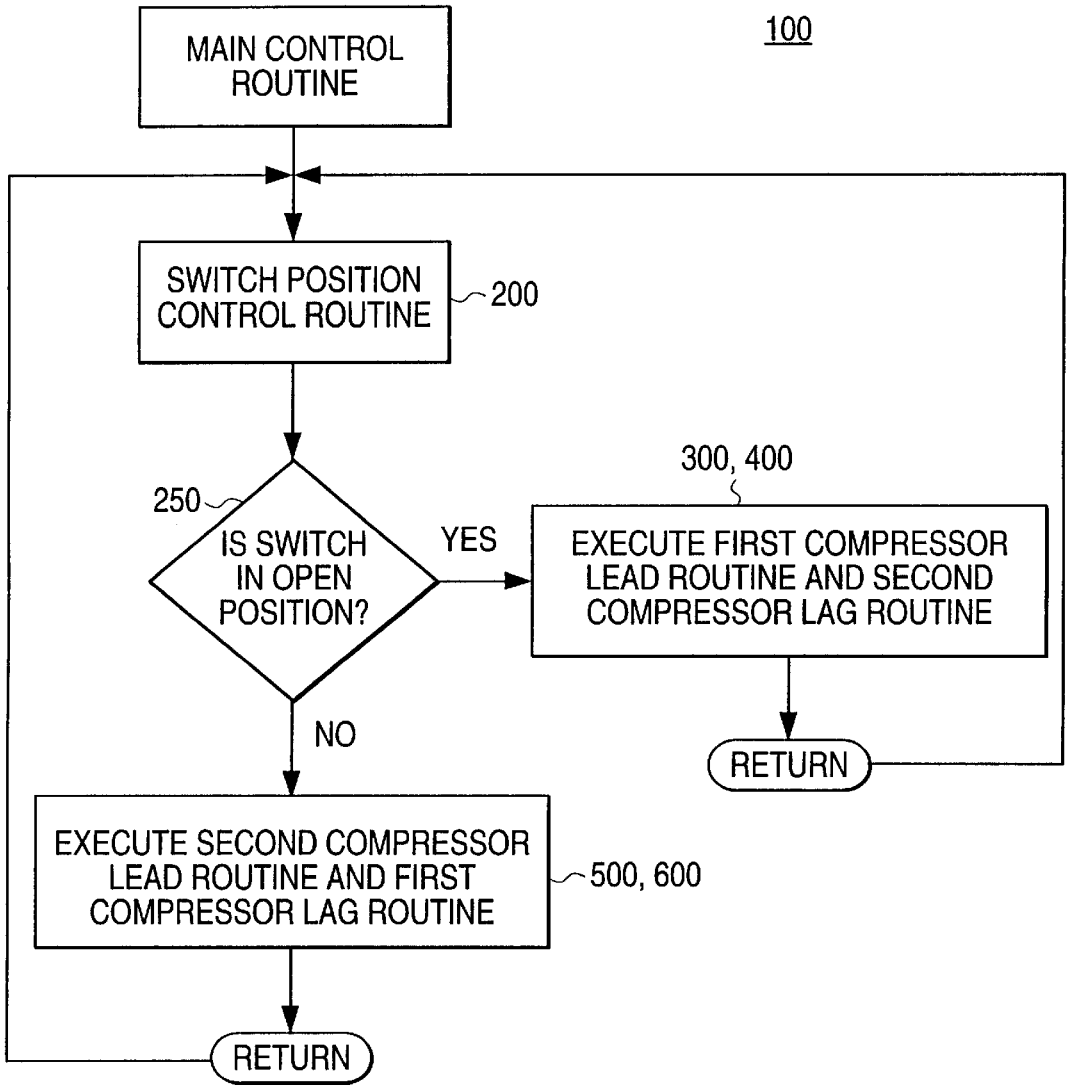
FIG. 2 shows a flowchart illustrating a main control routine for the compression system of FIG. 1 in accordance with certain preferred embodiments of the present invention.
Figure 3:
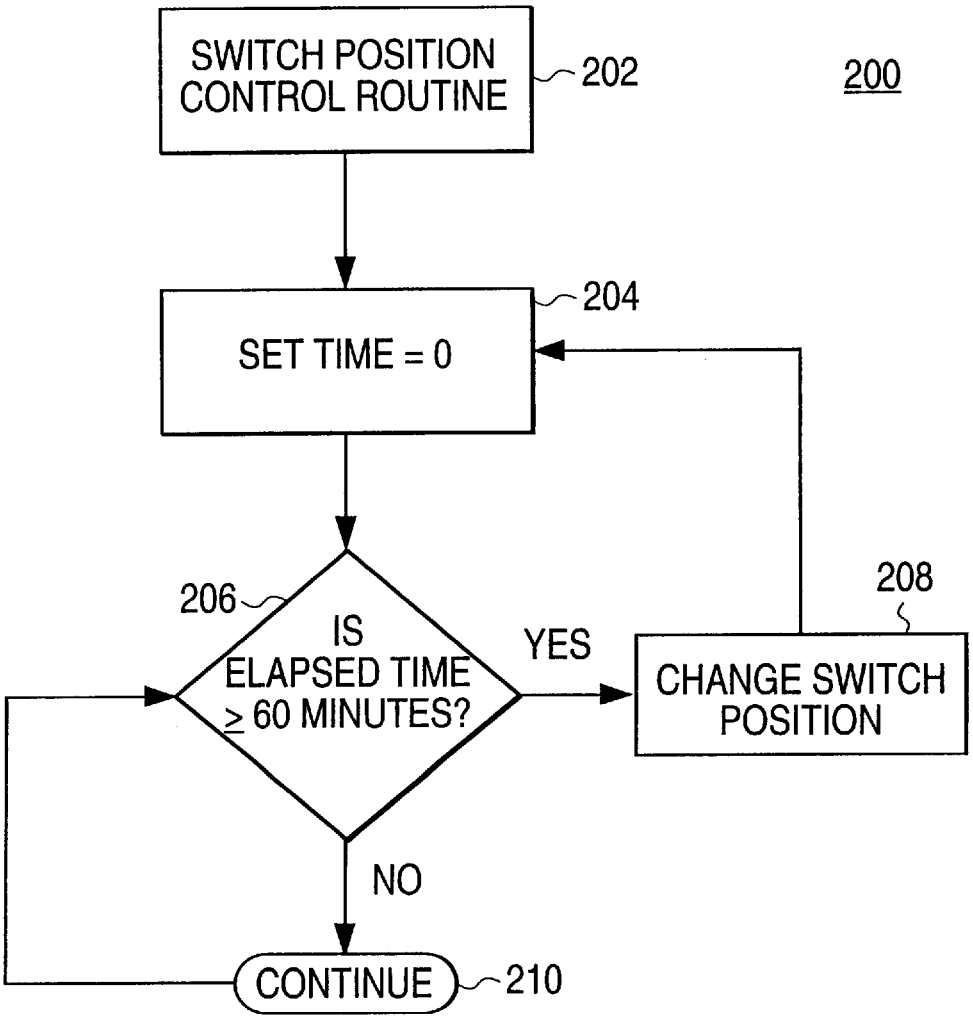
FIG. 3 shows a switch position control routine, identified in the flowchart shown in FIG. 2.

Referring to FIGS. 1 and 2, during execution of a main control routine 100 for operating the compression system, the microcontrollers 16 and 20 of the respective first and second compressors 12 and 14 continuously monitor the position of the switch 26. The actual position of the switch 26 is determined by a switch position control routine 200 (FIG. 3). At a first decision block 250, the main control routine 100 determines whether the switch 26 is in the first switch position 28A or the second switch position 28B. If the switch is in the first switch position 28A, the first microcontroller 16 of the first compressor 12 executes a lead compressor routine 300 therefor (FIG. 4) while the second microcontroller 20 of the second compressor 14 executes a lag compressor routine 400 therefor (FIG. 5). The microcontrollers 16 and 20 of the respective first and second compressors 12 and 14 continue to exercise their routines until the switch position is changed. Once the switch 26 moves to the second switch position 28B (shown by the dashed line of FIG. 1), the second microcontroller 20 of the second compressor 14 executes its lead compressor routine 500 (FIG. 6) while the first microcontroller 16 of the first compressor 12 executes its lag compressor routine 600 (FIG. 7).

Switch Position Control Routine

FIG. 3 shows the switch position control routine 200 illustrated in FIG. 2. As mentioned above, the switch position control routine 200 changes the position of the switch 26 so that the switch generally spends an equal amount of time in the first switch position 28A and the second switch position 28B which, in turn, results in the two compressors equally sharing lead compressor and lag compressor duties. After entering the switch position control routine at step 202, the routine sets time=0 at step 204. The routine then proceeds to step 206 for determining whether the elapsed time is greater than or equal to a predetermined time limit. For the particular embodiment shown in FIG. 3 the time limit for the routine has been set at 60 minutes, however, it is contemplated that the exact time limit may be modified in response to the demands placed upon a particular system. If 60 minutes have passed, then the routine proceeds to step 208 and the position of the switch 26 is changed, e.g., from the first switch position 28A to the second switch position 28B. If 60 minutes have not passed, then the routine proceeds to step 210 and the position of the switch 26 remains the same. The routine 200 then returns to the decision block at step 206 where it once again determined whether 60 minutes have passed. The routine continually loops between steps 206 and 210 until the 60 minute time period has expired. Once it is determined at step 206 that 60 minutes have expired, the routine changes the position of the switch at step 208 and resets the time to zero (0) at step 204. The switch position control routine 200 runs continuously during operation of the compression system.

Lead Compressor Routine for First Compressor

Figure 4:
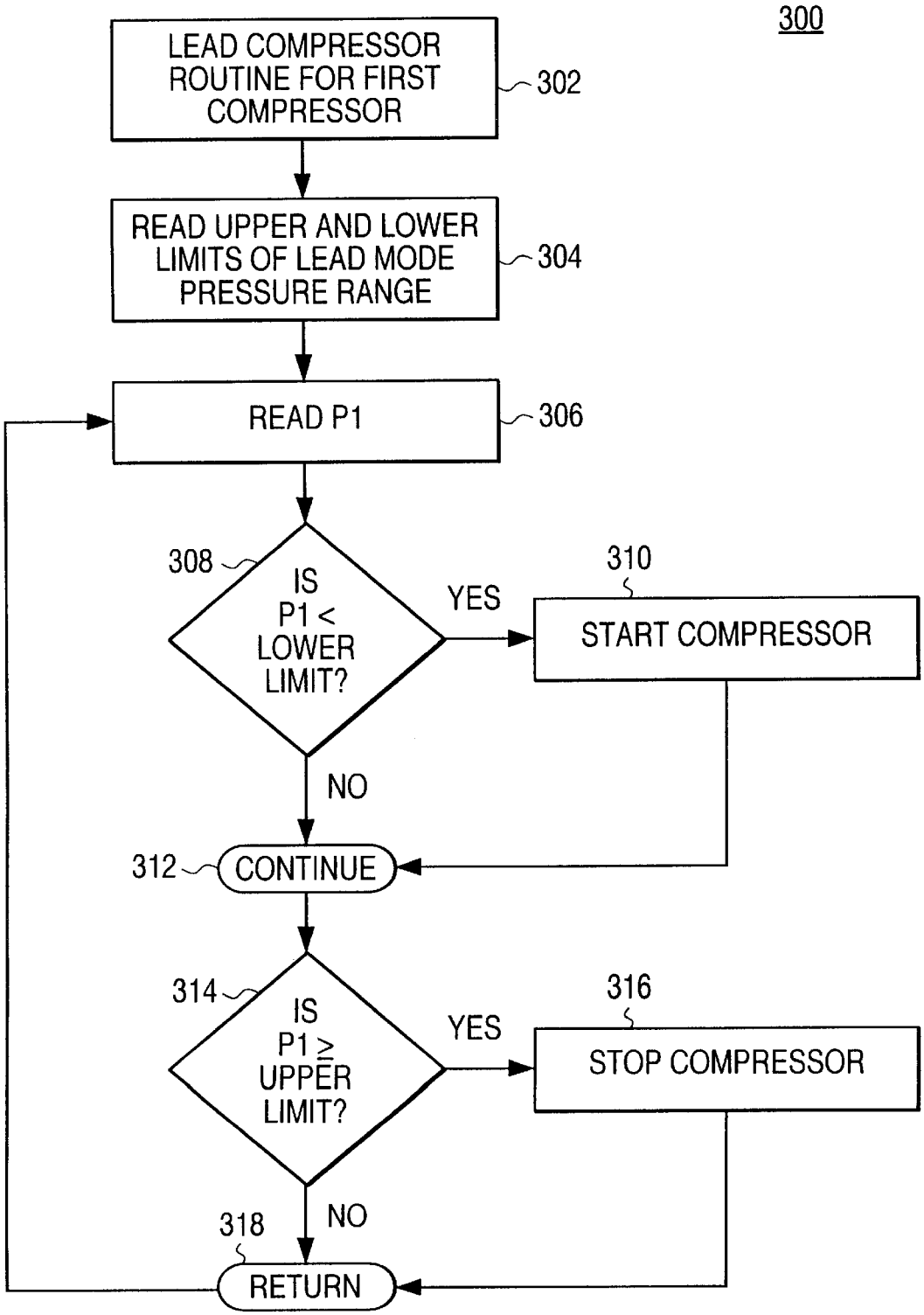
FIG. 4 shows a lead compressor routine for the first compressor, identified in the flowchart shown in FIG. 2.
Figure 5:
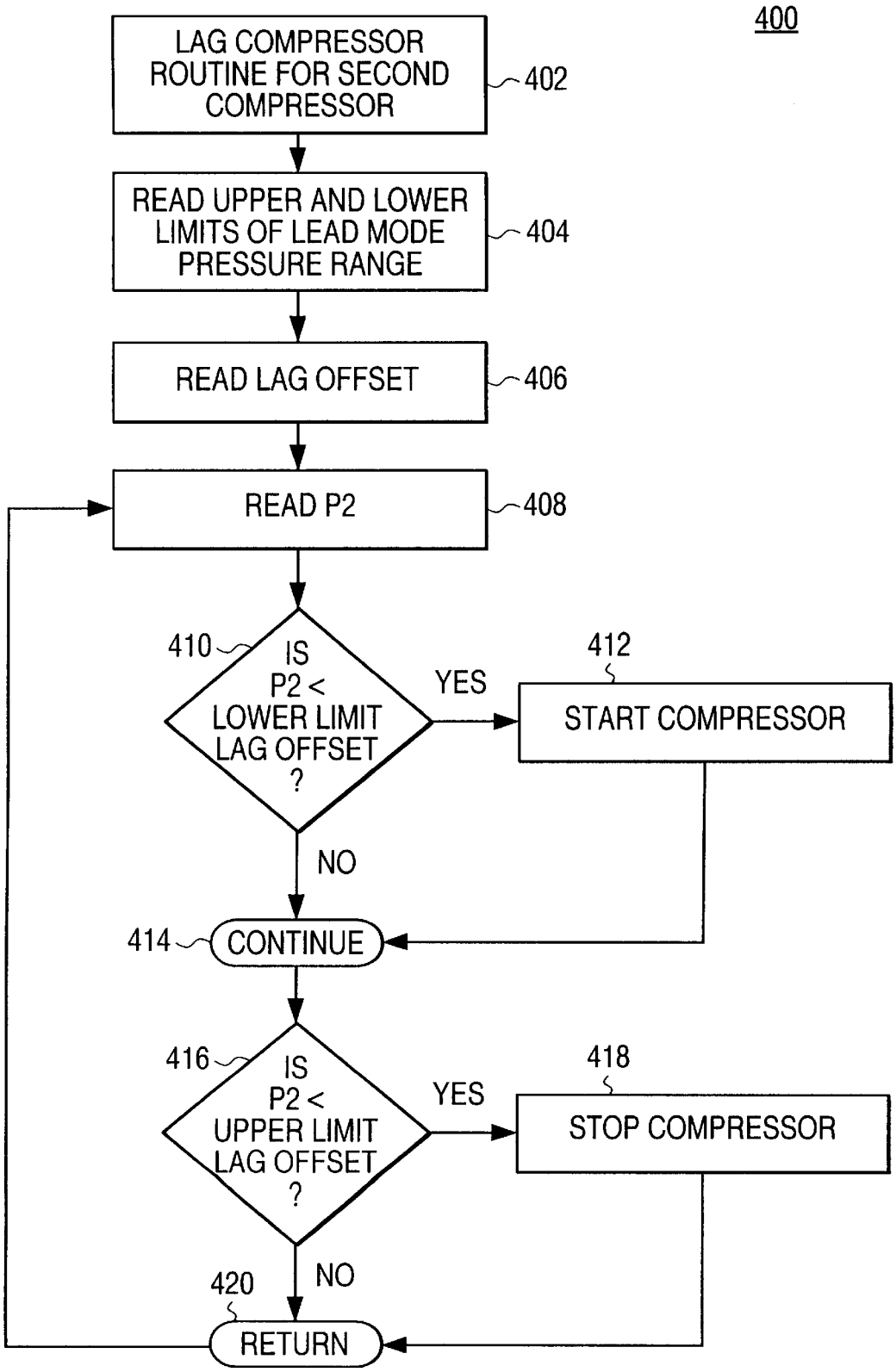
FIG. 5 shows a lag compressor routine for the second compressor, identified in the flowchart shown in FIG. 2.

Referring to FIGS. 1, 2 and 4, the lead compressor routine 300 for the first compressor is executed when the switch 26 is in the first switch position 28A. After entering the lead compressor routine at step 302, the first microcontroller 16 reads the upper pressure limit and the lower pressure limit of the lead mode pressure range at step 304. The first microcontroller 16 preferably includes a data entry device (not shown) for entering the upper and lower pressure limits. In preferred embodiments, the upper and lower pressure limits are established infrequently and may only have to be entered one time, e.g., during initial set up of the compression system 10. The routine 300 then proceeds to step 306 wherein the first pressure gauge 18 (FIG. 1) senses the pressure level of the compressed fluid discharged from the first compressor 12. The first pressure gauge 18 is in signal sending relationship with the first microcontroller 16 so that the sensed pressure level data may be continuously forwarded to the first microcontroller 16. At step 308, the first microcontroller 16 compares the sensed pressure level to the lower pressure limit. If the pressure is less than the lower pressure limit, the routine starts the first compressor at step 310. If the pressure level is greater then the lower pressure limit then the routine does not change the status of the first compressor 12 and continues to step 312. At step 314, the first microcontroller 16 compares the sensed pressure level to the upper pressure limit. If the pressure level is greater than or equal to the upper limit, then the first microcontroller 16 generates a signal for stopping the first compressor 12 at step 316. If the pressure level is less than the upper limit, then the first microcontroller 16 does not generate a stop signal and the first compressor 12 continues to run. The routine then proceeds to return step 318 and then back to step 306 during which a new pressure reading is taken. The lead compressor routine 300 for the first compressor 12 continues so long as the switch 26 remains in the first switch position 28A.

Lag Compressor Routine for Second Compressor

Referring to FIGS. 1, 2 and 5, the lag compressor routine 400 for the second compressor 14 is also executed when the switch 26 is in the first switch position 28A. After entering the lag compressor routine at step 402, the second microcontroller 20 reads the upper pressure limit and the lower pressure limit of the lead mode pressure range of the second compressor at step 404. The second microcontroller 20 preferably includes a data entry device for entering the upper and lower pressure limits of the lead mode pressure range. The second microcontroller 20 then reads the lag offset value at step 406. The lag offset value is also a numerical value which is selected by the user and entered into the second microcontroller 20 through the data entry device. Generally, when the second compressor 14 is set to lag mode, the compressor 14 will lower its upper and lower pressure ranges for starting and stopping by the amount set as the lag offset. After reading the lag offset, the routine proceeds to step 408 wherein the second pressure gauge 22 senses the pressure level of the compressed fluid discharged from the second compressor 14. The second pressure gauge 22 is in signal sending relationship with the second microcontroller 20 so that the sensed pressure level data may be continuously forwarded to the second microcontroller 20. At step 410, the second microcontroller 20 compares the sensed pressure level to the lower pressure limit minus the lag offset value. If the pressure sensed by the second pressure gauge 22 is less than the lower pressure limit minus the lag offset (i.e., Is P2<[lower limit−lag offset]?), the second microcontroller 20 generates a signal for starting the second compressor 14 at step 412. On the other hand, if the pressure level sensed by the second pressure gauge 22 is greater than the lower pressure limit minus the lag offset then the routine continues to step 414 and the operating status of the second compressor 14 does not change. At step 416, the second microcontroller 20 compares the sensed pressure level to the upper pressure limit minus the lag offset value (i.e., Is P2> or =[upper limit−lag offset]?) If the pressure level is greater than or equal to the upper limit minus the lag offset then the second microcontroller 20 generates a signal for stopping the second compressor 14 at step 418. On the other hand, if the sensed pressure level is less than the upper limit minus the lag offset, then the second microcontroller 20 does not generate a stop signal and the second compressor 14 continues to run. The routine then proceeds to return step 420 and then back to step 408 during which a new pressure reading is taken. The lag compressor routine 400 for the second compressor 14 continues so long as the switch 26 remains in the first switch position 28A.

Lead Compressor Routine for Second Compressor

Figure 6:
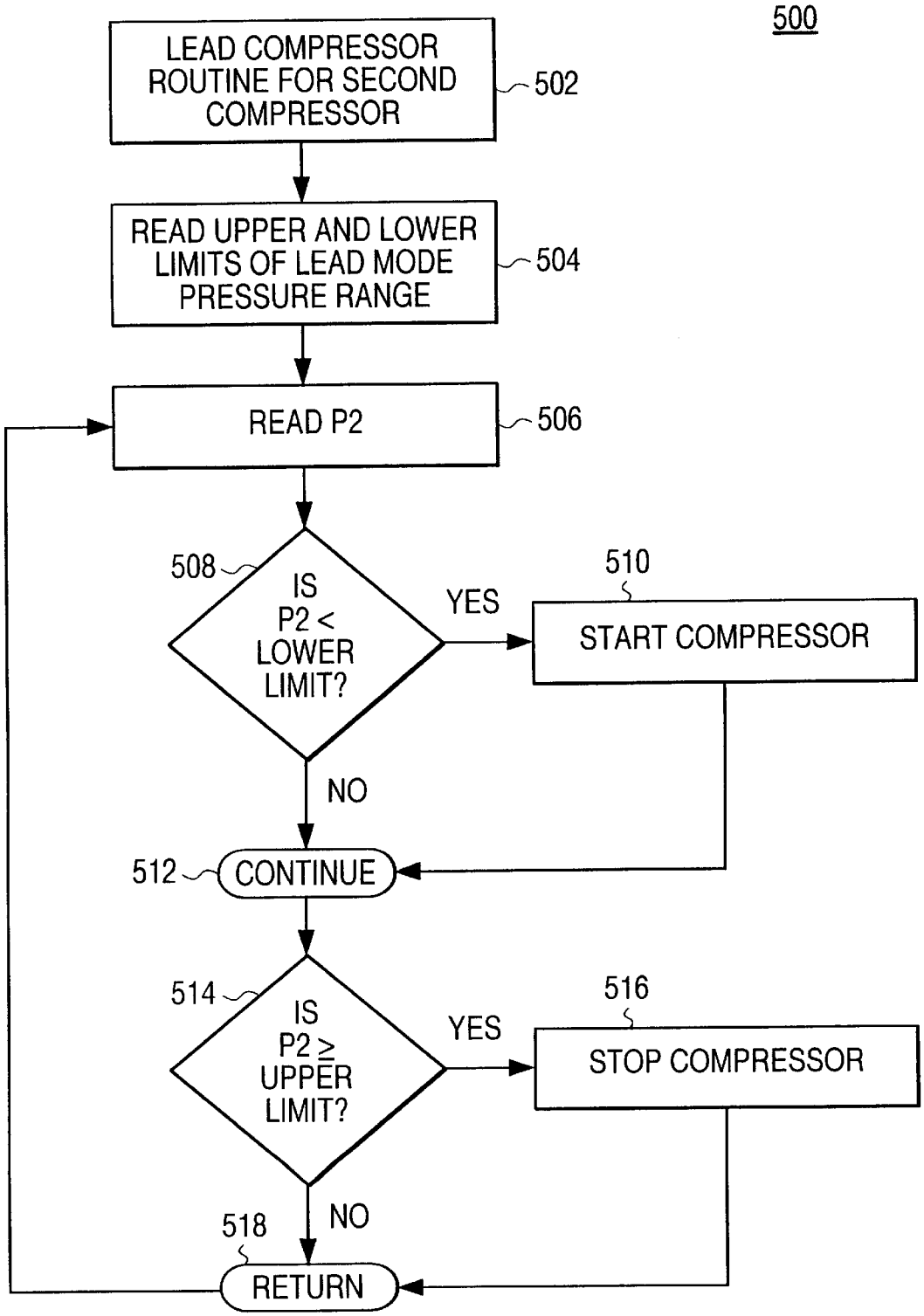
FIG. 6 shows a lead compressor routine for the second compressor, identified in the flowchart shown in FIG. 2.
Figure 7:
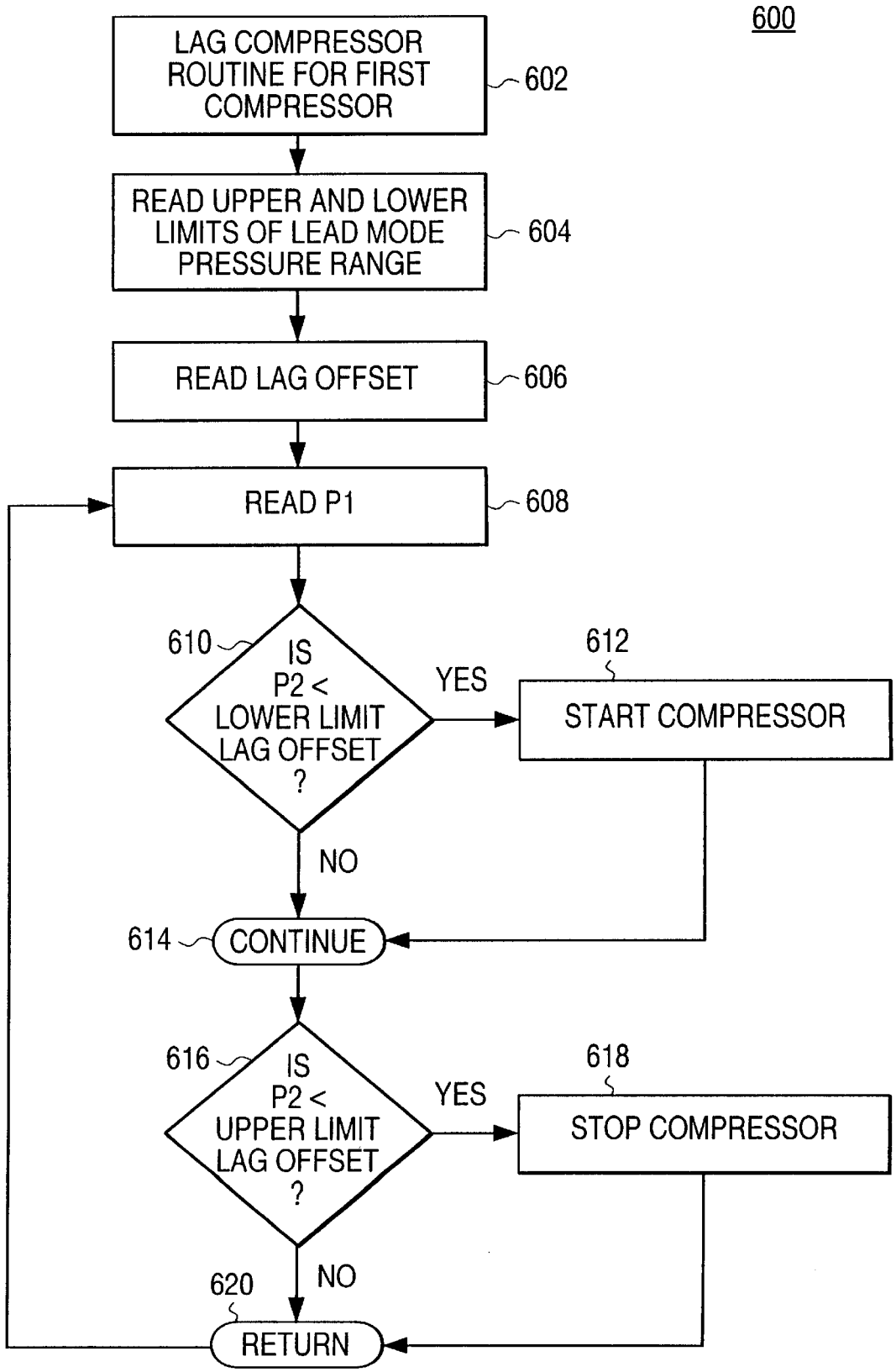
FIG. 7 shows a lag compressor routine for the first compressor, identified in the flowchart shown in FIG. 2.

Referring to FIGS. 1, 2 and 6, the lead compressor routine for the second compressor 500 is executed when the switch 26 is in the second switch position 28B. After entering the lead compressor routine at step 502, the second microcontroller 20 reads the upper pressure limit and the lower pressure limit of the lead mode pressure range at step 504. The second microcontroller 20 preferably includes a data entry device for entering the upper and lower pressure limits. As mentioned above, the upper and lower pressure limits are generally established infrequently and may only have to be entered once, e.g., during the initial setup of the compression system. The routine then proceeds to step 506 wherein the second pressure gauge 22 senses the pressure level of the compressed fluid discharged from the second compressor 14. The second pressure gauge 22 is in signal sending relationship with the second microcontroller 20 so that the sensed pressure level data may be continuously forwarded to the second microcontroller 20. At step 508, the second microcontroller 20 compares the sensed pressure level to the lower pressure limit of the lead mode pressure range. If the pressure is less than the lower pressure limit, the second microcontroller 20 generates a signal for starting the second compressor at step 510. If the pressure level is greater then the lower pressure limit then the routine continues to step 512 and the operating status of the second compressor 14 does not change. At step 514, the second microcontroller 20 compares the sensed pressure level to the upper pressure limit. If the pressure level is greater than or equal to the upper limit, then the second microcontroller 20 generates a signal for stopping the second compressor 14 and step 516. If the pressure level is less than the upper limit, then the second microcontroller 20 does not generate a stop signal and the second compressor 14 continues to run. The routine 500 then proceeds to return step 518 and then back to step 506 during which a new pressure reading is taken. The lead compressor routine for the second compressor 500 continues to be executed so long as the switch 26 is in the second switch position 28B.

Lag Compressor Routine for First Compressor

Referring to FIGS. 1, 2 and 7, the lag compressor routine for the first compressor 600 is executed when the switch 26 is in the second switch position 28B. After entering the lag compressor routine at step 602, the first microcontroller 16 reads the upper pressure limit and the lower pressure limit of the lead mode pressure range at step 604. The first microcontroller 16 preferably includes a data entry device for entering the upper and lower pressure limits of the lead mode pressure range. The first microcontroller 16 then reads the lag offset value at step 606. As mentioned above, the lag offset value is a numerical value which is selected by the user and entered into the first microcontroller 16 through the data entry device. Essentially, when the first compressor 12 is set to lag mode, the first microcontroller 16 will reduce its upper and lower pressure limits for starting and stopping by the amount established as the lag offset. After reading the lag offset, the routine proceeds to step 608 wherein the first pressure gauge 18 senses the pressure level of the compressed fluid discharged from the first compressor 12. At step 610, the first microcontroller 16 compares the sensed pressure level to the lower pressure limit minus the lag offset value. If the pressure sensed by the first pressure gauge 18 is less than the lower pressure limit minus the lag offset (i.e., Is P1<[lower limit−lag offset]?), the first microcontroller 16 generates a signal for starting the first compressor 12 at step 612. On the other hand, if the pressure level sensed by the first pressure gauge 18 is greater then the lower pressure limit minus the lag offset then the routine continues to step 614 and the operating status of the first compressor does not change. At step 616, the first microcontroller 16 compares the sensed pressure level to the upper pressure limit minus the lag offset value (i.e., Is P1> or =[upper limit−lag offset]?) If the pressure level is greater than or equal to the upper limit minus the lag offset then the first microcontroller 16 generates a signal for stopping the first compressor 12 at step 618. On the other hand, if the sensed pressure level is less than the upper limit minus the lag offset, then the first microcontroller 16 does not generate a stop signal and the first compressor continues to run. The routine then proceeds to return step 620 and then back to step 608 during which a new pressure reading is taken. The lag compressor routine for the first compressor 600 is continuously executed so long as the switch 26 remains in the second switch position 28B.

EXAMPLE

Referring to FIGS. 1–7, in one preferred embodiment of the present invention, the lead mode pressure range for the first compressor 300 is established by storing the lower pressure limit of 90 pounds/square inch (PSI) and the upper pressure limit of 100 PSI in the first microcontroller 16 of the first compressor 12. A lag offset value of 5 PSI is also stored in the first microcontroller 16. As a result of selecting the lag offset value of 5 PSI, the lag mode pressure range for the first compressor 12 is established having a lower pressure limit of 85 PSI (i.e., 90 PSI−5 PSI=85 PSI) and an upper pressure limit of 95 PSI (i.e., 100 PSI−5 PSI=95 PSI). The same values are also stored in the second microcontroller 20 of the second compressor 14 so that the lead mode pressure range for the second compressor 14 is between 90–100 PSI and the lag mode pressure range is between 85–95 PSI. The time limit for the switch position control routine 200 is set at 60 minutes.

In this particular preferred embodiment, the switch 26 is initially in the first switch position 28A. As a result, the main control routine 100 executes the lead compressor routine for the first compressor 300 (FIG. 4) and the lag compressor routine for the second compressor 400 (FIG. 5). In the lead compressor routine for the first compressor 300, the first microcontroller 16 will read that P1<90 PSI and will generate a signal for starting the first compressor at step 310. In the lag compressor routine for the second compressor 400, the second microcontroller 20 will read that P2<85 PSI and will generate a signal for starting the second compressor 14 at step 412. With the switch 26 in the first switch position 28A, the first compressor 14 will continue to run as long as the pressure sensed by the first pressure gauge 18 is less 100 PSI. However, the first microcontroller 16 will generate a signal for stopping operation of the first compressor 12 at step 316 once the pressure sensed by the first pressure gauge 18 is greater than or equal to 100 PSI. Moreover, while the switch 26 remains in the first switch position 28A, the second compressor 14 will continue to run as long as the pressure sensed by the second pressure gauge 22 is less than 95 PSI. The second microcontroller 20 will generate a signal for stopping operation of the second compressor 14 at step 418 once the pressure sensed by the second pressure gauge 22 is greater than or equal to 95 PSI. Thus, when the second compressor 14 is in the lag mode, the second compressor will generally stop operating before the first compressor.

After approximately 60 minutes the switch position control routine 200 (FIG. 3) will move the switch 26 from the first switch position 28A to the second switch position 28B. As a result, the main control routine 100 executes the lead compressor routine for the second compressor 500 and the lag compressor routine for the first compressor 600. In the lead compressor routine for the second compressor 500, if the second microcontroller 20 reads that P2<90 PSI at step 508, the second microcontroller will generate a signal for starting the second compressor 14 at step 510. At the same time, in the lag compressor routine for the first compressor 600, if the first microcontroller 16 reads that P1<85 PSI (lower limit 90 PSI−5 PSI offset=85 PSI) at step 610, the first microcontroller will generate a signal for starting the first compressor at step 612. With the switch 26 in the second switch position 28B, the second compressor 14 will continue to run as long as the pressure sensed by the second pressure gauge 22 is less 95 PSI. However, the second microcontroller 20 will generate a signal for stopping operation of the second compressor 14 at step 618 once the pressure sensed by the second pressure gauge is greater than or equal to 95

PSI. Moreover, while the switch 26 remains in the second switch position 28B, the first compressor 12 will continue to run as long as the pressure sensed by the first pressure gauge 18 is less than 95 PSI. The first microcontroller 16 will generate a signal for stopping operation of the first compressor 12 once the pressure sensed by the first pressure gauge 18 is greater than or equal to 95 PSI. Thus, when the first compressor 12 is in the lag mode, the first compressor 12 will generally stop operating before the second compressor 14.

After approximately 60 minutes, the switch position control routine 200 will move the switch 26 from the second switch position 28B to the first switch position 28A. The main control routine 100 will once again execute the lead routine for the first compressor 300 and the lag routine for the second compressor 400. The compression system 10 will continue to operate as outlined above so as to sequence operation of the first and second compressors 12 and 14.

While various preferred embodiments of the present invention have been shown and described herein, it will be understood by those skilled in the art that changes in form and details may be made without departing from the spirit and scope of the invention, as defined in the claims appended hereto.

What is claimed is:

1. A compression system comprising:

means for sequencing operation of a first compressor and a second compressor so that each said compressor alternates between a lead mode and a lag mode;

said first compressor including means for operating said first compressor within a lead mode pressure range when said first compressor is in the lead mode and a lag mode pressure range when said first compressor is in the lag mode; and said second compressor including means for operating said second compressor within a lead mode pressure range when said second compressor is in the lead mode and a lag mode pressure range when said second compressor is in the lag mode, wherein the operating means of said first and second compressors function independently of one another; and wherein the microcontroller for each said compressor determines the lower pressure limit of the lag mode pressure range by subtracting a lag offset value from the lower pressure limit of the lead mode pressure range for said compressor, and wherein the microcontroller for each said compressor determines the upper pressure limit of the lag mode pressure range by subtracting the lag offset value from the upper pressure limit of the lead mode pressure range for said compressor.

2. The compression system as claimed in claim 1, wherein each said compressor is the primary source of compressed fluid for said compression system when in the lead mode and the secondary source of compressed fluid for said compression system when in the lag mode.

3. The compression system as claimed in claim 2, wherein the operating means of each said compressor includes a microcontroller having a data entry device for establishing the lead mode pressure range and the lag mode pressure range, and a pressure gauge for determining a pressure level of the compressed fluid discharged therefrom.

4. The compression system as claimed in claim 3, wherein the pressure gauge of each said compressor senses the pressure level of the compressed fluid discharged therefrom and relays the sensed pressure level to the microcontroller associated with said compressor.

5. The compression system as claimed in claim 4, wherein said microcontroller continuously monitors the pressure level of the compressed fluid and compares the pressure level of the compressed fluid to the lead mode pressure range and the lag mode pressure range.

6. The compression system as claimed in claim 5, wherein if said compressor is in the lead mode said microcontroller generates signals for operating said compressor when the pressure level is within the lead mode pressure range, and if said compressor is in the lag mode said microcontroller generates signals for operating said compressor when the pressure level is within the lag mode pressure range.

7. The compression system as claimed in claim 6, wherein the lead mode pressure range includes a lower pressure limit and an upper pressure limit so that when each said compressor is in the lead mode said compressor commences operation for generating the compressed fluid when the pressure level is less than the lower pressure limit and ceases operation of said compressor when the pressure level is greater than or equal to the upper pressure limit.

8. The compression system as claimed in claim 7, wherein the lag mode pressure range includes a lower pressure limit and an upper pressure limit so that when each said compressor is in the lag mode said compressor commences operation for generating the compressed fluid when the pressure level is less than the lower pressure limit and ceases operation of said compressor when the pressure level is greater than or equal to the upper pressure limit.

9. The compression system as claimed in claim 1, wherein the data entry device of each said microcontroller provides means for establishing the upper and lower limits of the lead mode pressure range and the lag offset value for each said compressor.

10. The compression system as claimed in claim 8, wherein the lag mode pressure range for each said compressor is lower than the lead mode pressure range of said compressor.

11. The compression system as claimed in claim 8, wherein the lag mode pressure range of said second compressor overlaps with at least a portion of the lead mode pressure range of said first compressor, and wherein the lag mode pressure range of said first compressor overlaps with at least a portion of the lead mode pressure range of said second compressor.

12. The compression system as claimed in claim 1, wherein the sequencing means includes a switch movable between a first switch position and a second switch position for alternating the status of the first and second compressors so that one of said compressors is always in the lead mode and one of said compressors is always in the lag mode.

13. The compression system as claimed in claim 12, wherein when said switch is in said first switch position said first compressor is in the lead mode and said second compressor is in the lag mode and when said switch is in said second switch position said first compressor is in the lag mode and said second compressor is in the lead mode.

14. The compression system as claimed in claim 12, wherein said sequencing means includes a timing device for automatically moving the switch between the first and second switch positions.

15. The compression system as claimed in claim 1, further comprising a storage tank in fluid communication with the first and second compressors for receiving and storing the compressed fluid generated by said compressors.

16. A compression system comprising:

a switch movable between a first switch position and a second switch position for alternating a first compressor and a second compressor between a lead mode and a lag mode so that one of said compressors is always in the lead mode and one of said compressors is always in the lag mode;

a first compressor including a first microcontroller having a data entry device for establishing a lead mode pressure range and a lag mode pressure range, said first compressor including a first pressure gauge for sensing a pressure level of compressed fluid discharged therefrom and relaying the sensed pressure level to said first microcontroller, wherein said first microcontroller continuously monitors the pressure level of the compressed fluid discharged therefrom and compares the pressure level of the compressed fluid to the lead mode pressure range and the lag mode pressure range; and a second compressor including a second microprocessor having a data entry device for establishing a lead mode pressure range and a lag mode pressure range, said second compressor including a second pressure gauge for sensing a pressure level of compressed fluid discharged therefrom and relaying the sensed pressure level to said second microcontroller, wherein said second microcontroller continuously monitors the pressure level of the compressed fluid discharged therefrom and compares the pressure level of the compressed fluid to the lead mode pressure range and the lag mode pressure range;

wherein said first microcontroller and said first pressure gauge function independently of said second microcontroller and said second pressure gauge;

and wherein the microcontroller for each said compressor determines the lower pressure limit of the lag mode pressure range by subtracting a lag offset value from the lower pressure limit of the lead mode pressure range for said compressor, and wherein the microcontroller for each said compressor determines the upper pressure limit of the lag mode pressure range by subtracting the lag offset value from the upper limit of the lead mode pressure range for said compressor.

17. The compression system as claimed in claim 16, wherein if said first compressor is in the lead mode said first microcontroller generates signals for operating said compressor when the sensed pressure level is within the lead mode pressure range, and if said first compressor is in the lag mode said first microcontroller generates signals for operating said first compressor when the pressure level is within the lag mode pressure range.

18. The compression system as claimed in claim 16, wherein if said second compressor is in the lead mode said second microcontroller generates signals for operating said second compressor when the sensed pressure level is within the lead mode pressure range, and if said second compressor is in the lag mode said second microcontroller generates signals for operating said second compressor when the pressure level is within the lag mode pressure range.

19. The compression system as claimed in claim 18, wherein the lead mode pressure range for each said compressor includes a lower pressure limit and an upper pressure limit so that when each said compressor is in the lead mode said compressor commences operation for generating the compressed fluid when the sensed pressure level is less than the lower pressure limit and ceases operation of said compressor when the sensed pressure level is greater than or equal to the upper pressure limit; and wherein the lag mode pressure range of each said compressor includes a lower pressure limit and an upper pressure limit so that when each said compressor is in the lag mode said compressor commences operation for generating the compressed fluid when the pressure level is less than the lower pressure limit and ceases operation of said compressor when the pressure level is greater than or equal to the upper pressure limit, the lag mode pressure range for each said compressor being lower than the lead mode pressure range for said compressor.

* * * * *